United States Patent [19]

Angele

[11] Patent Number: 4,526,113

[45] Date of Patent: Jul. 2, 1985

[54] METHOD AND APPARATUS FOR MANUFACTURING PANTYHOSE

[75] Inventor: Werner Angele, Au am Rhein, Fed. Rep. of Germany

[73] Assignee: Pfaff Industriemaschinen GmbH, Fed. Rep. of Germany

[21] Appl. No.: 615,390

[22] Filed: May 30, 1984

Related U.S. Application Data

[62] Division of Ser. No. 411,335, Aug. 25, 1982.

[51] Int. Cl.[3] ..... D05B 29/06; D05B 35/02

[52] U.S. Cl. ..... 112/127; 112/151; 112/235

[58] Field of Search ..... 112/127, 126, 151, 150, 112/235

[56] References Cited

U.S. PATENT DOCUMENTS

| | | | |
|---|---|---|---|
| 1,712,047 | 5/1929 | Moffatt | 112/126 X |
| 1,903,425 | 4/1933 | Gordon | 112/151 |
| 2,172,569 | 9/1939 | Sigoda | 112/127 X |
| 3,096,735 | 7/1963 | Wise | 112/151 |

*Primary Examiner*—H. Hampton Hunter
*Attorney, Agent, or Firm*—McGlew and Tuttle

[57] ABSTRACT

A method of manufacturing pantyhose by means of sewing machine using hose shaped leg parts comprises arranging the leg parts in a flattened side by side longitudinal relationship, cutting each leg part along an edge from the waist rim of its panty area up to a crotch leaving a remaining leg portion of each leg uncut so as to form upper and lower plies of each leg cut along their inner opposite edges, sewing the cut edges of the laterally adjacent plies together from the waist rim to the crotch to form a seam, deflecting the outer plies outwardly to overlie the remaining leg portions and continuing to sew the seam by sewing in the same direction the edge portions of the upper plies together. A sewing machine carrying out the invention includes a presser foot having a sole with a toe shaped front part which engages into each leg portion of the pantyhose to be formed. Each presser foot part has a guide edge and a deflecting sheet so that when the material leg parts are advanced in respect to the presser foot the leg portions are slid along adjacent side edges to form upper and lower ply portions and the upper ply portions are deflected by the deflecting blades outwardly to overlie the remaining leg portions. The sewing machine is provided with reciprocating needles which extend through an opening of the sole to form a seam which will be made in a continous manner from the rim of the waist portion to the crotch area joining the lower ply edges together and then beyond the crotch area to join the upper ply edges together moving in the same direction, while the leg portions are spread outwardly so that the sewing needles will not engage them.

2 Claims, 5 Drawing Figures

METHOD AND APPARATUS FOR MANUFACTURING PANTYHOSE

This is a division of application Ser. No. 411,335 filed Aug. 25, 1982.

FIELD AND BACKGROUND OF THE INVENTION

This invention relates in general to the construction of sewing machines and to a new and useful method and apparatus for effecting the formation of a pantyhose by sewing it in a continuous seam.

German OS No. 17 60 537 discloses a method of manufacturing wedgeless pantyhose, in which two and two leg parts are superposed, the adjacent inner panty zones are placed below the presser foot on the feeder of the overcast sewing machine and, starting from the upper end of the leg parts, both leg parts are cut open up to the crotch in a single operation and, at the same time, one panty side is sewed together, and upon reversing the motion, the sewing is accomplished by sewing the seam on the other panty side.

In this method, the continuity of operation is interrupted by reversing the motion of the crotch, since shortly before, the sewing speed must be reduced and then the work must be turned into a new position prior to continuing the sewing in the opposite direction, beyond the crotch, while advancing the work.

Since in overcast machines, the cutting knife works at a distance from the needle, which distance is predetermined by the width of the overcast seam, and an exact guidance parallel to the cut edge of the work, which very readily curls in at the edges, is not possible, the provided guidance is such that the edges are cut close ahead of the stitch-forming area, so as to ensure that the cut edges are properly fastened by the overcast stitches. The same is done during the sewing of the second seam, from the crotch to the waist, where the leg parts are already cut open, so that there, material is wasted and the circumferential size of the leg parts in the panty area is reduced. With wedgeless pantyhose, this is a particularly serious disadvantage reducing the quality of the fitting shape.

Since during the formation of the overcast seam, the leg parts in addition are moved through the stitch forming area not in their later position of use but in a position turned thereto through about 90°, the overcast seam is thickened to a protuberant beading making the pantyhose uncomfortable to wear.

U.S. Pat. No. 3,621,493 discloses another method of this kind in which two tubular leg parts are superposed, with the seat area being in register, whereupon, starting from the waist rim, the two plies of material are cut open up to the crotch and simultaneously sewed together at their edges each by an overcast seam. This, however, requires a securing seam in the crotch zone, to connect the two separate seams, thus an additional sewing operation. The wearing quality already unfavorably affected by the overcast seam is thereby further impaired.

An objective of the invention is to improve the manufacture of wedgeless pantyhose, by making the operation smoother, and by bettering the wearing properties and thus the quality of the finished article.

Acordingly it is an object of the invention to provide a method of manufacturing pantyhose by means of a sewing machine using hose shaped leg parts which comprises arranging the leg parts in a flat side by side longitudinally extending relationship, cutting each leg part along one edge from the waist rim of its panty area up to a crotch, leaving a remaining leg portion of each leg uncut so as to form upper and lower plies of each leg cut along their inner opposite edges, sewing the cut edges of the laterally adjacent lower plies together from the waist rim to the crotch to form a seam, and deflecting the outer plies outwardly to overlie the remaining leg portions and continuing to sew the seam by sewing in the same direction the edge portions of the upper plies together.

A further object of the invention is to provide a sewing machine which includes a sewing machine foot having two spaced apart toe portions which are engageable at the leg portions of material to be formed at the pantyhose and with deflecting areas for deflecting the upper ply areas of the leg portions upwardly as they are being cut along their adjacent edges to form upper and lower ply areas.

A further object of the invention is to provide a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 2:
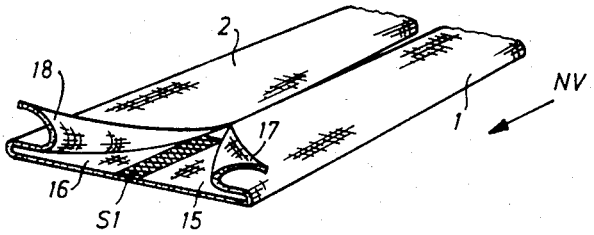
FIG. 2 is a view similar to FIG. 1 showing leg portions with an initially open seam and a cut portion forming upper and lower ply parts.
Figure 5:
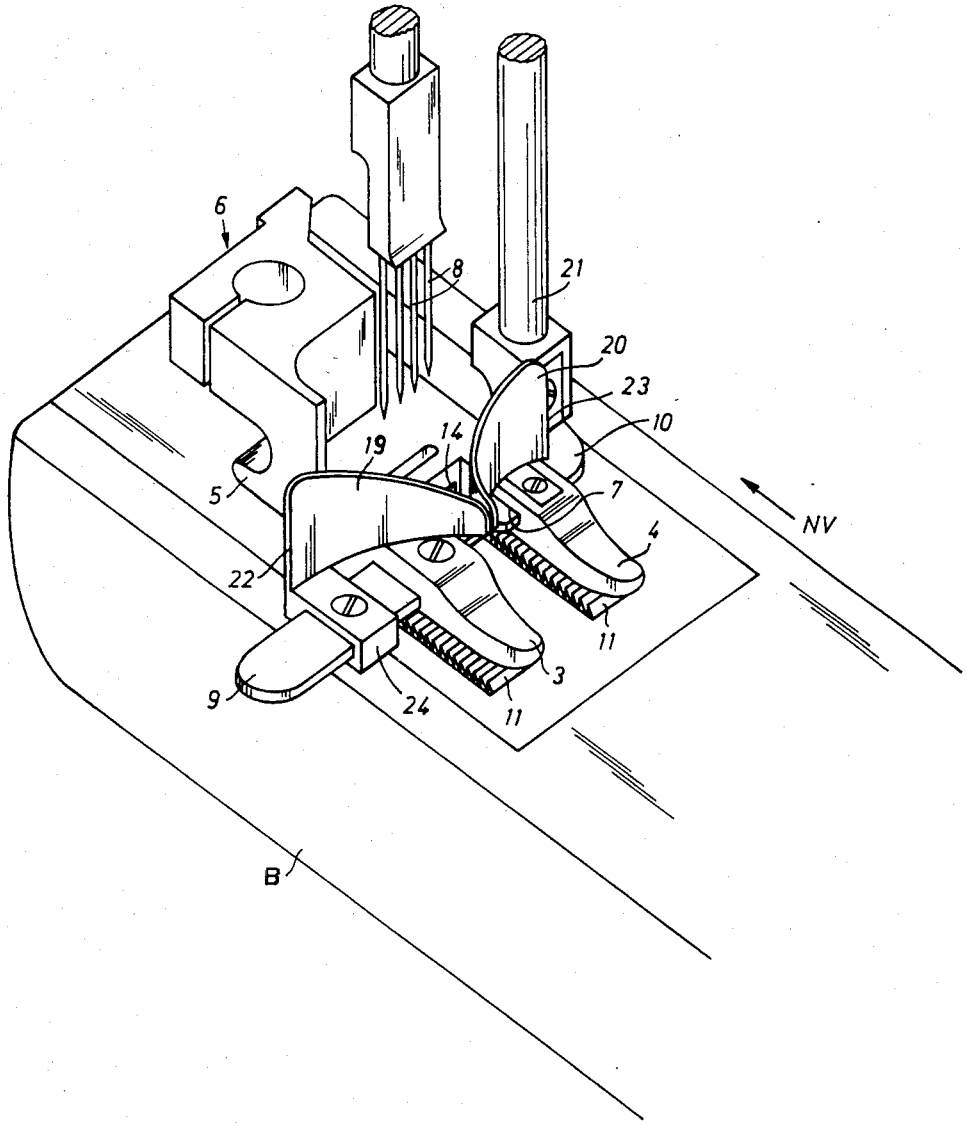
FIG. 5 is a front top perspective view of a presser foot of a sewing machine for carrying out the invention.

Referring to the drawings in particular the invention embodied therein comprises a sewing machine shown in FIG. 5 for carrying out a method of the invention to form pantyhose using whole shaped leg parts 1 and 2. In accordance with the method of the invention, the leg parts are arranged in side by side flat conditions so as to extend longitudinally. They are positioned in association with toe-shaped front parts 3 and 4 of a presser foot 6 of a sewing machine shown in FIG. 5. As shown in FIG. 2 after the leg parts are cut along their inner edges so as to form upper and lower plies of the materials and to leave a remaining uncut leg portion. As shown in FIG. 2, the cut edges of the lower ply portions are sewn together at S1.

Figure 3:
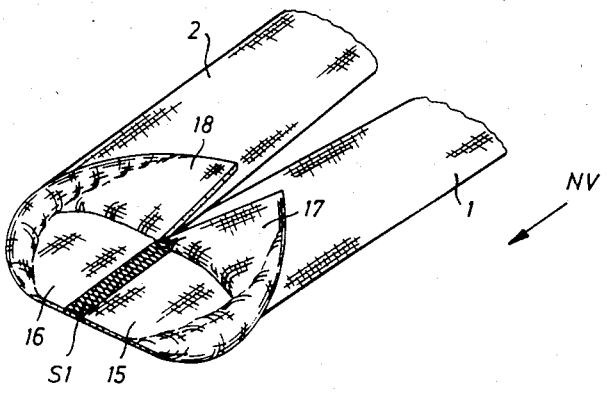
FIG. 3 is a view similar to FIG. 1 showing the pantyhose in a position just prior to forming a final seam stitch.
Figure 4:
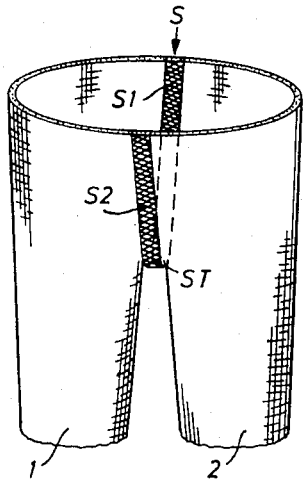
FIG. 4 is a front top perspective view of the finished pantyhose constructed in accordance with the invention.

The sewing operation is carried out in one direction contrary to the direction of feed as indicated by the arrow NV and during the initial stages the upper plies are bent over on the remaining portion of the legs as shown in FIG. 3 and the seam S is continued to form the seam portion S2 by joining the edges of the upper plies together along edges 17 and 18.

Figure 1:
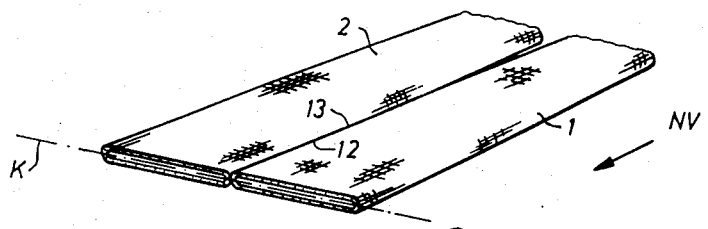
FIG. 1 is a front top perspective view of the arrangement of two leg portions of material to be formed into pantyhose.

Two hose-shaped panty leg parts 1 and 2 are placed flat, one alongside the other, on the work plate or arm B of a sewing machine, preferably a multi-thread overlap stitch flat seam machine, in a manner such that they abut each other in the area of the seat portion of the pantyhose to be manufactured. The leg parts 1 and 2 are then shifted, with their open front ends ahead, over the toe-shaped front parts 3 and 4 of a sole 5 of presser foot 6 which is in lifted position for this purpose. In this way, leg part 1 is displaced along toe part 3 and leg part 2 along toe part 4 up to a knife 10 which is mounted for moving transversely to needles 8 in a guideway 7 of sole 5 of presser foot 6 and cooperates with a counter blade 9 which is secured in sole 5. In this position, the leg parts are engaged by feed dog 11 of the sewing machine. The cutting plane of knife 10 is indicated at K in FIG. 1. This plane extends about intermediate the two plies of each of the leg parts lying flat on the workplate, and passes through the abutting edges 12, 13 thereof. As the sewing machine is started upon lowering presser foot 6, leg parts 1, 2 are fed by feed dog 11 in the direction of arrow NV in FIGS. 1–3 with abutting edges 12 and 13 of the lower plies 15,16 passing through a groove 14 of sole 5 and across the path of motion of knife 10 to the stitch-forming area.

Leg parts 1 and 2 are thus cut open in the seat area of the pantyhose from the waist to the crotch and simultaneously the adjacent cut edges of their plies 15 and 16 are sewed together by a known multi-thread overlap stitch flat seam line S with a lay thread, to a seam S1 extending at the backside from the waist to the crotch. Seam line S may be formed by one of stitch types 602–607 DIN 61400.

During this first cutting and sewing operation, cut edges 17 and 18 of the upper plies of leg parts 1, 2 which have not yet been sewn, are not fed to the stitch-forming area, they are guided away, both from the stitch-forming area and from the knife driving bar 21 (known per se), by guide surfaces 19 and 20 which are provided on presser foot 6 and extend outwardly in opposite directions. FIG. 2. Guide surfaces 19 and 20 are embodied by deflector sheets 22 and 23. Sheet 22 is provided with a slide shoe 24 by which it is engaged on the fixed counterblade 9, while sheet 23 is secured to toe part 4 of presser foot sole 5.

Cut edges 17 and 18 are thus guided outwardly to both sides, are then folded back by the operator, in the direction opposite to arrow NV, as shown in FIG. 3, so that upon finishing the seam S1 from the waist to the crotch ST, a second seam S2 continuously following the first one, from the crotch ST to the waist, can immediately and without interruption be sewn, with the feed in the same direction NV and without changing the position of leg parts 1 and 3 relative to one another, only they must be held by the operator apart from each other, out of the stitch-forming area.

The operation in accordance with the inventive method is smooth and free from interruptions. By forming a flat seam instead of an overcast one, the wearing comfort of the pantyhose is substantially increased, and providing guide surfaces 19, 20 for the upper plies of the leg parts 1, 2 ensures that the operator can entirely concentrate on the supply and handling of the material to be sewn and is not required to check whether or not the upper plies of leg parts 1 and 2 have inadvertently passed below needles 8. This provides a method and device simplifying the work, feed and handling and improving the quality of the product.

While specific embodiments of the invention have been shown and described in detail to illustrate the application of the principles of the invention, it will be understood that the invention may be embodied otherwise without departing from such principles.

What is claimed is:

1. A device for manufacturing pantyhose using hose shaped leg parts for a workpiece comprises a sewing machine having a presser foot with an opening therethrough through which the sewing machine needles may pass and having a sole with laterally spaced apart toe-shaped parts engageable into the respective leg portions, knife means carried by said presser foot adjacent the sewing machine needle opening for cutting through the leg material along the edges thereof and deflecting means for deflecting the upper plies of the cut leg portions upwardly to overlap a remaining uncut portion of the leg portions during sewing.

2. A sewing machine according to claim 1, said knife comprises a counter blade slidable on one of said presser foot toe portions and a knife positionable on the other of said presser foot portions and deflector means comprising a blade arranged on each of said toe-shaped presser foot portions including a guide surface extending upwardly and downwardly from between said toe-shaped portions laterally outwardly.

* * * * *